US005190844A

United States Patent [19]

Yabuuchi et al.

[11] Patent Number: 5,190,844

[45] Date of Patent: Mar. 2, 1993

[54] PRODUCTION OF SURFACE-MODIFIED ORGANIC PARTICLES

[75] Inventors: Naoya Yabuuchi, Suita; Akihiro Kanakura, Hirakata; Takahito Kishida, Yao; Masayuki Maruta, Hannan; Koichi Nagata, Neyagawa; Makoto Shimizu, Osaka, all of Japan

[73] Assignee: Nippon Paint Co., Ltd., Osaka, Japan

[21] Appl. No.: 803,418

[22] Filed: Dec. 6, 1991

[30] Foreign Application Priority Data

Dec. 7, 1990 [JP] Japan ..... 2-409779
Dec. 14, 1990 [JP] Japan ..... 2-410831

[51] Int. Cl.[5] ..... G03G 9/097

[52] U.S. Cl. ..... 430/137; 427/222; 524/154; 524/183; 524/236; 524/287; 524/351; 524/352; 524/904; 525/934

[58] Field of Search ..... 430/137; 427/222; 524/904; 525/934

[56] References Cited

U.S. PATENT DOCUMENTS 4,828,954 5/1989 Hashimoto et al. ..... 430/137 X
4,859,560 10/1989 Nakamura et al. ..... 430/137
5,069,994 12/1991 Gitzel et al. ..... 430/137 X

FOREIGN PATENT DOCUMENTS 2081921 2/1982 United Kingdom .

OTHER PUBLICATIONS

Patent Abstract of Japan, vol. 14, No. 264 (P-1057) (4207) Jun. 7, 1990 and JP-A020773371 (Matsushita) Mar. 13, 1990 *abstract*.

Patent Abstract of Japan, vol. 13, No. 357 (P-915) (3705) Aug. 10, 1990 and JP-A-1116564 (Mita) May 9, 1989 *abstract*.

Patent Abstracts of Japan, vol. 13, No. 50 (P-823) (3398) Feb. 6, 1989 and JP-A-63244055 (Canon) Oct. 11, 1988 *abstract*.

*Primary Examiner*—Roland Martin
*Attorney, Agent, or Firm*—Wenderoth, Lind & Ponack

[57] ABSTRACT

The present invention provides an improved process for producing organic particles (e.g. toner particles) having uniform charge controlling coating and excellent charge controlling effect. In the process, a dispersion comprising the organic particles (A), a specific compound (B) forming insoluble substances upon reacting with an insolubilizer (D) and a dispersing medium is prepared and then reacted with the insolubilizer (D).

16 Claims, No Drawings

PRODUCTION OF SURFACE-MODIFIED ORGANIC PARTICLES

FIELD OF THE INVENTION

The present invention relates to a process for producing organic particles of which the surface is covered with insoluble substances, particularly charge controlling substances. More particularly, it relates to a process for producing organic particles which are covered with a charge controlling agent and which are suitable for electrophotographic toner.

BACKGROUND OF THE INVENTION

Toner for developing electrophotography generally contains a charge controlling agent. The charge controlling agent may be contained in or carried on the toner particles by, for example, a melt-grinding method (Japanese Kokai Publications 2-161468 and 2-161469), a suspension polymerization method (Japanese Kokai Publication 2-1618271), a dry-coating method (Japanese Kokai Publication 2-161471).

In the melt-grinding method and the suspension polymerization method, the charge controlling agent is admixed with the toner matrix resin or the monomer composition and contained as the resulting toner components. Accordingly, an effective rate of the charge controlling agent is little and, in the suspension polymerization, the agglomeration of the charge controlling agent often occurs. In the dry-coating method, the charge controlling agent is coated on the surface of the toner particles to enhance the effective rate of the charge controlling agent. The charge controlling agent, however, forms agglomerates which are difficult to dissolve, thus the effective rate not being improved. The coating of the particles also has ununiformity.

SUMMARY OF THE INVENTION

The present invention provides an improved process for producing organic particles (e.g. toner particles) having uniform charge controlling coating and excellent charge controlling effect. The method is characterized by, into a dispersion comprising;

(A) organic particles, (B) a compound selected from the group consisting of

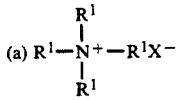

(I)

wherein $R^1$, the same or different, represents a hydrogen atom, an alkyl group having 1 to 22 carbon atoms, an aryl group having 6 to 22 carbon atoms which may be substituted, and X represents an halogen atom,

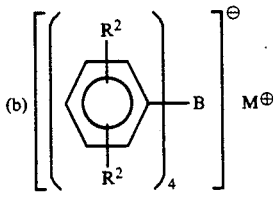

(II)

wherein $R^2$, the same or different, represents a hydrogen atom, an alkyl group having 1 to 22 carbon atoms, and M represents an alkali metal,

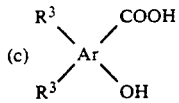

(III)

wherein Ar represents a benzene ring or a naphthalene ring, $R^3$, the same or different, represents a hydrogen atom, an alkyl group having 1 to 22 carbon atoms, and the groups —COOH and —OH are present on two carbon atoms which are adjacent to each other in the Ar ring, and (d) a polymer with weight average molecular weight 2,000 to 200,000 having a quaternary salt group (C) a dispersing medium in which the organic particles are insoluble;

adding an insolubilizer (D) which is reacted with the compound (B) to form an insoluble substance.

DETAILED DESCRIPTION OF THE INVENTION

The organic particles (A) employed in the present invention may be prepared by art-known methods, such as melt-grinding method, suspension polymerization, dispersion polymerization, interfacial polycondensation, emulsion polymerization and the like. The organic particles can be any organic particles, but preferably toner particles which contain a colorant (e.g. carbon black), if necessary a releasing agent and magnetic powder. The organic particles (A) preferably have a weight average particle size of 0.1 to 100 micrometer, more preferably 2.5 to 12.5 micrometer for toner. Examples of the matrix resin of the organic particles are polystyrenes or poly(substituted styrenes) (e.g. polystyrene, polyvinyltoluene), styrene-substituted styrene copolymer, styrene-acrylate copolymer, styrene-methacrylate copolymer, styrene-acrylonitrile copolymer, polyvinyl chloride, polyolefin, silicone resin, polyester, polyurethane, polyamide, epoxy resin, modified rosin, phenol resin and the like.

The compound (B) of the present invention is selected from the group consisting of the compounds (a), (b), (c) and (d).

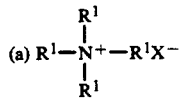

(I)

wherein $R^1$, the same or different, represents a hydrogen atom, an alkyl group having 1 to 22 carbon atoms, an aryl group having 6 to 22 carbon atoms which may be substituted, and X represent an halogen atom.

Typical examples of the group $R^1$ are hydrogen; an alkyl group, such as methyl, ethyl, propyl, butyl, pentyl, hexyl, octyl, nonyl, decyl, dodecyl, tetradecyl, hexadecyl, octadecyl etc.; a substituted or non-substituted aryl group, such as phenyl, naphthyl, tolyl, benzyl, p-chlorobenzyl, phenetyl, anthryl etc.; and the like. The group X includes chlorine, fluorine, bromine and the like. The subtituent of the group $R^1$ may include a halogen atom, a cyano group, and the like. Typical examples of the compounds (a) are tetramethylammonium chloride, cetyltrimethylammonium chloride, distearyldimethylammonium chloride, benzyltrimethylammonium chloride and the like.

The compound (b) is represented by the formula II. The group $R^2$ can be the same as the group $R^1$. The alkali metal M includes sodium, potassium, lithium and the like. Typical examples of the compounds (b) are sodium tetraphenylborate, sodium tetratolylborate and the like.

The compound (c) is represented by the formula III. The group $R^3$ can be the same as the group $R^1$. Typical examples of the compounds (c) are substituted or non-substituted salicylic acid, substituted or non-substituted 2-hydroxy-1-naphthoic acid, substituted or non-substituted 1-, or 2-hydroxy-2-naphthoic acid and the like.

The polymer (d) has a weight average molecular weight of 2,000 to 200,000, preferably 10,000 to 100,000 and also contains a quaternary salt group, preferably an ammonium salt group represented by the following;

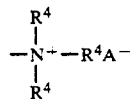

(IV)

wherein $R^4$, the same or different, represents a hydrogen atom, an alkyl group having 1 to 22 carbon atoms, an aryl group having 6 to 22 carbon atoms which may be substituted, and $A^-$ represents a molybdate anion, a tungstate anion, a heteropolyacid anion including a molybdenum atom or a tungsten atom.

The group $R^4$ can be the same as the group $R^1$ and $A^-$ includes $(Mo_7O_{24})^{6-}$, $(H_2W_{12}O_{42})^{10-}$, $(SiW_{12}O_{40})^{4-}$, $(BW_{12}O_{40})^{5-}$ and $(BMo_{12}O_{40})^{5-}$. If the molecular weight is less than 2,000, charge controlling ability is poor. If it is more than 200,000, the polymer often agglomerates between the molecules. It is preferred that the quaternary salt group is contained in an amount of 2 to 100 mol % in one molecule. If the quaternary salt group is less than 2 mol %, charge controlling ability is poor. If it is more than 100 mol %, the polymer often agglomerates between the moleculars. The polymer (B) may be formed by polymerizing vinyl monomers having a quaternary salt group and optionally other copolymerizable monomers. Typical examples of the vinyl monomers having a quaternary salt group are $CH_2{=}CH(CH_3)COOCH_2CH_2N^+(CH_3)_3.Cl^-$, $CH_2{=}CHCONHC_3H_6N^+(CH_3)_3.Cl^-$ a mixture thereof and the like. Typical examples of the other copolymerizable monomers are styrene, (meth)acrylates (e.g. methyl methacrylate, n-butyl methacrylate, 2-ethylhexyl acrylate, ethyl acrylate) and the like. The polymerization method is not limited, but for example emulsion polymerization, solution polymerization and the like. In case of copolymerization, the vinyl monomers having a quaternary salt group may be polymerized to form a prepolymer having the quaternary salt groups, which is then grafted by copolymerizing the other copolymerizable monomers. Also, a mixture of the vinyl monomers having a quaternary salt group and the other copolymerizable monomers may be formed and then randomly copolymerized. Further, monomers having a tertiary amino group may be polymerized with the other copolymerizable monomers and then quaterized. An amount of the vinyl monomers having a quaternary salt group is preferably 2 mol % or more, more preferably 10 mol % or more based on the total monomer amount.

The dispersing medium (C) employed in the present invention is one which does not dissolve the organic particles (A) and the insolubilized substance (e.g. a charge controlling substance), including water, alcohols, ethyleneglycol monoalkyl ethers (Cellosolves) and the like. Typical examples of alcohols are methanol, ethanol, isopropanol, n-butanol and the like. Typical examples of the Cellosolves are methyl Cellosolve, ethyl Cellosolve and the like.

A dispersion is prepared by mixing the components (A), (B) with the dispersing medium (C). The dispersion may contain an additive, such as a dispersion stabilizer (e.g. polyvinyl alcohol, polyoxyethylene, hydroxyethyl cellulose, polyacrylic acid and the like.

The insolubilizer (D) is added to the dispersion obtained above and mixed to form the organic particles which are covered with insoluble substances. The insolubilizer (D) is one which reactd with the component (B) to form insoluble substances (e.g. charge controlling substances). The component (D) can be selected in relation to the component (B). If the component (B) is the compound (a), the insolubilizer (D) includes molybdate (e.g. $(Mo_7O_{24})^{6-}NH_4)_6^+$), phosphomolybdate (e.g. $(PMo_{12}O_{40})^{3-}NH_4)_3^+$), tungstate (e.g. $(H_2W_{12}O_{42})^{10-}(NH_4)_{10}^+$), phosphotungstate (e.g. $(PW_{12}O_{42})^{3-}(NH_4)_3^+$), heteropolyacid containing molybdenum or tungsten (e.g. $SiW_{12}O_{40})^{4-}(NH_4)_4^+$, $(BW_{12}O_{40})^{5-}(NH_4)_5^+$ and $BMo_{12}O_{40})^{5-}(NH_4)_5^+$), and the like. If the compound (B) is the compound (b), the insolubilizer is selected from the compound (a), a compound (e) represented by

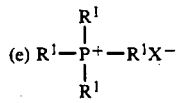

(I)

wherein $R^1$ and X are the same as mentioned above, and a compound (f) represented by

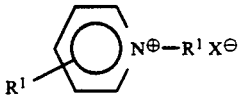

wherein $R^1$ and X are the same as mentioned above. Typical examples of the compounds (e) are tetramethylphosphonium chloride, cetyltrimethylphosphonium chloride and the like. Typical examples of the compounds (e) are cetylpyridinium chloride, stearylpyridinium chloride and the like. If the compound (B) is the compound (c), a chelating agent (e.g. zinc acetate, chromium acetate and the like) may be employed as the insolubilizer (D). The insolubilizer (D) may be a combination of more than two compounds. If the compound (B) is the polymer (d) having a quaternary salt group, the insolubilizer (D) is a compound which is ion-exchanged with the quaternary salt group to precipitate an insoluble ionic polymer, for example a molybdate, such as $(Mo_7O_{24})^{6-}(NH_4)_6^+$, $(PMo_{12}O_{40})^{3-}(NH_4)_3^+$, the compound (b), and a mixture thereof.

The organic particles (A) may be employed in an amount of 2 to 100 parts by weight, preferably 10 to 50 parts by weight, based on 100 parts by weight of the dispersing medium (C). The compound (B) may be employed in an amount of 0.05 to 25 parts by weight, preferably 0.1 to 10 parts by weight and the insolubilizer (D) may be 0.02 to 45 parts by weight, preferably 0.05 to 30, both based on 100 parts by weight of the organic particles.

According to the present invention, the organic particles which are covered with insoluble substances are obtained. The particles may be subjected to a heat treatment at 40° to 90° C. to ensure the coating or covering on the particles. Temperatures of less than 40° C. do not provide the effects of the heat treatment and those of more than 90° C. often weld the particles together. The heat treatment can be conducted by mixing them at an elevated temperature.

The amount of the coating or covering on the organic particles may be 0.025 to 25% by weight, preferably 0.1 to 10% by weight, based on the total weight of the resulting covered particles.

The resulting organic particles according to the present invention have a coating layer with some functions, especially charge controlling properties, and therefore are suitable for toner. The coating layer on the particles may also have anti-blocking properties and therefore the toner obtained therefrom has good flowability. The organic particles are very suitable for low-temperature fixing toner, pressure-fixing toner or microcapsuled toner.

EXAMPLES

The present invention is illustrated by the following Examples which, however, are not to be construed as limiting the present invention to their details.

PREPARATION EXAMPLE 1

Toner was prepared from the following ingredients.

| Ingredients | Parts by weight |
|---|---|
| Styrene/n-butyl methacrylate resin (64/36) | 88 |
| Regal 330*1 | 8 |
| Bicol 660P*2 | 4 |

*1Carbon black available from Cabot Company.
*2Polypropylene wax available from Sanyo Chemical Industries Ltd.

The above ingredients were melted and mixed and then cooled. It was then finely ground and classified to obtain toner having a weight average particle size of 10.5 micrometer.

PREPARATION EXAMPLE 2

A dispersion was prepared from the following ingredients.

| Ingredients | Parts by weight |
|---|---|
| Styrene | 85 |
| 2-Ethylhexyl acrylate | 15 |
| Solsperce #20000*3 | 4 |
| Solsperce #5000*4 | 0.4 |
| Styrene/dimethylaminopropyl methacrylamide copolymer (95/5; MW 12,000) | 24 |
| Divinyl benzene | 0.5 |
| V-40*5 | 2 |
| MOGUL-L*6 | 12 |

*3Pigment dispersant available from ICI.
*4blue dye available from ICI.
*5Azo polymerization initiator available from Wako Junyaku Co., Ltd.
*6Carbon black available from Carbon orp.

The resulting dispersion was mixed with 400 parts by weight of deionized water, 8 parts by weight of polyvinyl alcohol and 25 parts by weight of ethylene glycol, and polymerized for 6.5 hours at 90° C. The resulting toner particles have a particle size of 8.2 micrometer and rinsed three times with deionized water. It was stored as a dispersion.

PREPARATION EXAMPLE 3

A mixture was prepared from the following ingredients.

| Ingredients | Parts by weight |
|---|---|
| n-Propnol | 950 |
| Deionized Water | 250 |
| Hydroxypropyl cellulose | 30 |

The resulting mixture was heated to 65° C., to which 90 parts by weight of n-butyl methacrylate, 60 parts by weight of styrene, 30 parts by weight of MOGUL-L, 0.6 parts by weight of Solsperce #5,000, 23.4 parts by weight of styrene/acrylester (MW 8500) and 55 parts by weight of acryl-modified wax were added and mixed for 30 minutes. To the content, 150 parts by weight of styrene and 9.0 parts by weight of V-59 (azo polymerization initiator available from Wako Junyaku Co., Ltd.) were added and polymerized for 22 hours. The resulting toner particles have a particle size of 7.2 micrometer and rinsed three times with a 50/50 n-propanol/deionized water mixture. It was stored in a dispersion.

PREPARATION EXAMPLE 4

A dispersion was prepared from the following ingredients.

| Ingredients | Parts by weight |
|---|---|
| n-Lauryl methacrylate | 50 |
| Styrene | 50 |
| MOGUL-L | 12 |
| Biscol 660 P | 6.0 |
| Styrene/dimethylaminopropyl methacrylamide copolymer (95/5, MW 12,000) | 6.0 |
| Toluene diisocyanate | 12 |
| V-59 | 1.5 |

The resulting dispersion was mixed with 400 parts by weight of a 2% polyvinyl alcohol aqueous solution (available from Kuraray Co., Ltd.), to which 7.5 parts by weight of hexamethylenediamine was added dropwise and mixed 60 minutes. It was then heated to 75° C. and polymerized for 6.5 hours. The resulting toner particles have a particle size of 14.0 micrometer and rinsed three times with deionized water. It was stored in a dispersion.

PREPARATION EXAMPLE 5

A mixture of 1,200 parts by weight of deionized water and 6.0 parts by weight of cetyltrimethylammonium chloride was heated to 80° C., to which 270 parts by weight of styrene, 29 parts by weight of methyl methacrylate and 1.0 part by weight of divinyl benzene were added. Then, a mixture of 3.0 parts by weight of V-50 available from Wako Junyaku Co., Ltd. and 100 parts by weight of deionized water were added dropwise over one hour and polymerized for 2 hours to obtain toner particles having 120 nm.

PREPARATION EXAMPLE 6

Toner Preparation by Suspension Polymerization

A dispersion was prepared from the following ingredients.

| Ingredients | Parts by weight |
|---|---|
| Styrene | 85 |
| 2-Ethylhexyl acrylate | 15 |
| Regal 1330 R (Cabot) | 10 |
| Solsperce #5000 | 0.2 |
| Styrene/acrylester (90/10) | 10 |
| Acryl-modified wax | 17.5 |
| Lauroyl peroxide | 1.5 |
| V-40 | 1.5 |

The resulting dispersion was mixed with 450 parts by weight of deionized water, 12 parts by weight of hydroxyethyl cellulose, 1.2 parts by weight of polyethyleneglycol nonyl phenyl ether and 0.045 parts by weight of potassium iodide, and polymerized for 7 hours at 90° C. The resulting toner particles have a particle size of 8.2 micrometer and rinsed three times with deionized water. It was stored as a dispersion.

PREPARATION EXAMPLE 7

Toner Preparation by Dispersion Polymerization

A dispersion was prepared from the following ingredients.

| Ingredients | Parts by weight |
|---|---|
| Styrene | 70 |
| n-Butyl methacrylate | 30 |
| Regal 1330 R (Cabot) | 10 |
| Phthalocyanine blue | 0.5 |
| Polymer of 18 epsilon-caplolactone of which the end modified wih carboxylic acid | 7.5 |
| Acryl-modified wax | 17.5 |
| V-59 | 1.5 |

The resulting dispersion was mixed with 320 parts by weight of isopropanol, 80 parts by weight of deionized water and 10 parts by weight of hydroxypropyl cellulose (available from Nippon Soda Co., Ltd. as HPC-L), and polymerized for 22 hours at 65° C. The resulting toner particles have a particle size of 7.0 micrometer and rinsed three times with a 50/50 isopropanol/deionized water mixture. It was stored in water.

PREPARATION EXAMPLE 8

Toner Having a Low Tg by Dispersion Polymerization

Toner was prepared as generally described in Preparation Example 7, with the exception that 2-ethylhexyl acrylate was employed instead of n-butylmethacrylate. The toner particles had a particle size of 6.5 micrometer.

PREPARATION EXAMPLE 9

Preparation of an Emulsion Polymerization Latex Having Polycation

An aqueous solution was prepared from the following ingredients.

| Ingredients | Parts by weight |
|---|---|
| Deionized water | 360 |

-continued

| Ingredients | Parts by weight |
|---|---|
| A quaterize salt polymer having an SH group*7 | 20 |

*7having polymerization degree of about 300 from: a monomer mixture of quaterized dimethylaminopropyl methacrylamide, available from Kuraray Co., Ltd.

The resulting solution was heated to 75° C., to which 40 parts by weight of deionized water, 2.0 parts by weight of V-50 (Azo polymerization initiator available from Wako Junyaku Co., Ltd.), 60 parts by weight of styrene and 40 parts by weight of methyl methacrylate were added and polymerized for 3.5 hours to obtain a polymer latex with particle size of 160 nm to which polycationic groups were absorbed.

EXAMPLES 1 TO 5

A dispersion was prepared by dispersing the organic particles A, 200 g of isopropanol, 300 g of deionized water and the compound B in one liter beaker using a TK homomixer as the formulation as shown in Table 1. To the dispersion, the compound D was added and mixed for 15 minutes. The resulting mixture was centrifuged and dried by warm air for 48 hours to obtain toner.

EXAMPLE 6

The emulsion of Preparation Example 5 (solid content 100 g) was mixed with 0:65 g of ammonium molybdate to form precipitations. The precipitations were filtered and dried, followed by grinding by a jet mil.

COMPARATIVE EXAMPLE 1

The toner obtained in Preparation Example 1 was mixed with 0.75 parts by weight of potassium tetraphenylborate and melted and ground to form toner.

EXAMPLE 7

Toner was prepared by mixing the particles of Example 6 with the toner of Example 1 in an amount of 1.0% by weight based on the amount of the toner of Example 1.

Image Test

Each toner of Examples 1 to 5, Example 7 and Comparative Example 1 was mixed with carrier. The resulting toner mixtures of Example 1, 4, 5 and Comparative Example 1 were subjected to an image test using a modified copy machine available from Sharp Corp. as 8600, and the toner mixtures of Examples 2, 3 and 7 were also subjected to an image test using a modified copy machine available from Sharp Corp. as 8800. The toner of Comparative Example 1 showed blushing, but the other toner mixtures showed no blushing.

EXAMPLE 8

An aqueous dispersion of 100 g of toner particles of Preparation Example 6 was mixed with the latex of Preparation Example 9 having resin content 2.0 g, to which 0.34 g of ammonium molybdate was added and mixed for 10 minutes. The resulting mixture was centrifuged and dried by blowing air at 40° C.

EXAMPLE 9

An aqueous dispersion of 100 g of toner particles of Preparation Example 7 was mixed with 0.5 g of Catiomer 300 (polycation available from Sanyo Chemical Industries Ltd.), to which 0.65 g of sodium tetraphenylborate was added and mixed for 10 minutes. The resulting mixture was dried as generally described in Example 8.

EXAMPLE 10

An aqueous dispersion of 100 g of toner particles of Preparation Example 8 was mixed with 2.5 g of Catiomer 300 (polycation available from Sanyo Chemical Industries Ltd.) and 0.5 g of cetyltrimethylammonium chloride, to which ammonium tetraphenylborate was slowly added and mixed for 10 minutes. The resulting mixture was dried as generally described in Example 8, but no blocking was seen.

COMPARATIVE EXAMPLE 2

The toner particles of Preparation Example 7 were dried without the surface treatment.

COMPARATIVE EXAMPLE 3

The resulting toner particles of Preparation Example 8 was tried to dry as described in Example 1, but blocking of toner particles was severely seen.

Image Test

Each toner of Examples 8 to 10 and Comparative Example 2 was mixed with carrier. The resulting toner mixtures were subjected to an image test using a modified copy machine available from Sharp Corp. as 8800, and the toner mixtures of Examples 2, 3 and 7 were also subjected to an image test using a modified copy machine available from Sharp Corp. as 8800. The toner of Comparative Example 1 showed blushing, but the other toner mixtures showed no blushing. The toner of Example 10 could be fixed even with a heat roll having 135° C.

TABLE 1

| Ex. No. | Organic particles A (gram) | Compound B (gram) | Compound D (gram) |
|---|---|---|---|
| 1 | Preparation Ex. 1 (100) | Di-t-butylsalicylic acid (0.30) | Zinc acetate (0.22) |
| 2 | Preparation Ex. 2 (100) | Benzyltrimethyl-ammonium chloride (0.10) | Ammonium molybdate (0.032) |
| 3 | Preparation Ex. 3 (100) | Cetyltrimethyl ammonium chloride (0.20) | Ammonium molybdate (0.064) |
| 4 | Preparation Ex. 3 (100) | Tetraphenyl borate (0.15) | Tetramethyl ammonium chloride (0.035) |
| 5 | Preparation Ex. 4 (100) | Tetraphenyl borate (0.05) | Potassium chloride (0.020) |

What is claimed is:

1. A process for producing organic particles which are covered with insoluble substances, characterized by, into a dispersion comprising;

(A) organic particles, (B) a compound selected from the group consisting of (a) 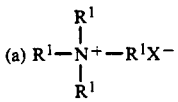

(I)

wherein $R^1$, the same or different, is a hydrogen atom, an alkyl group having 1 to 22 carbon atoms or an aryl group having 6 to 22 carbon atoms which may be substituted, and X represents an halogen atom, (b) 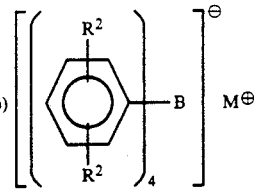

(II)

wherein $R^2$, the same or different, is a hydrogen atom or an alkyl group having 1 to 22 carbon atoms, and M represents an alkali metal, (c) 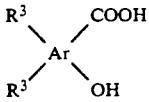

(III)

wherein Ar is a benzene ring or a naphthalene ring, $R^3$, the same or different, is a hydrogen atom or an alkyl group having 1 to 22 carbon atoms, and the groups —COOH and —OH are present on two carbon atoms which are adjacent to each other in the Ar ring, and (d) a polymer with weight average molecular weight 2,000 to 200,000 having a quaternary salt group (C) a dispersing medium in which the organic particles are insoluble and in which compound (B) is soluble;

adding an insolubilizer (D) which is reacted with the compound (B) to form an insoluble substance.

2. The process according to claim 1 wherein said organic particles (A) are toner particles having a weight average particle size of 0.1 to 100 micrometer.

3. The process according to claim 1 wherein the matrix resin of said organic particles (A) are polystyrenes or poly(substituted styrenes), styrene-substituted sytrene copolymer, styrene-acrylate copolymer, styrene-methacrylate copolymer, styrene-acrylonitrile copolymer, polyvinyl chloride, polyolefin, silicone resin, polyester, polyurethane, polyamide, epoxy resin, modified rosin or phenol resin.

4. The process according to claim 1 wherein said compound (a) is selected from the group consisting of tetramethylammonium chloride, cetyltrimethylammonium chloride, distearyldimethylammonium chloride and benzyltrimethylammonium chloride.

5. The process according to claim 1 wherein said compound (b) is selected from the group consisting of sodium tetraphenylborate and sodium tetratolylborate.

6. The process according to claim 1 wherein said compound (c) is selected from the group consisting of substituted or non-substituted salicylic acid, substituted or non-substituted 2-hydroxy-1-naphthoic acid, substituted or non-substituted 1-hydroxy-2-naphthoic acid and substituted and non-substituted 2-hydroxy-2-naphthoic acid.

7. The process according to claim 1 wherein said polymer (d) has a quaternary ammonium salt group represented by

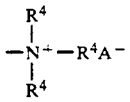

(IV)

wherein $R^4$, the same or different, is a hydrogen atom, an alkyl group having 1 to 22 carbon atoms or an aryl group having 6 to 22 carbon atoms which may be substituted, and $X^-$ represents a heteropolyacid anion.

8. The process according to claim 1 wherein said said polymer (d) is formed by polymerizing vinyl monomers having a quaternary ammonium salt group and other copolymerizable monomers.

9. The process according to claim 1 wherein said dispersing medium (C) is selected from the group consisting of water, alcohols, ethyleneglycol monoalkyl ethers.

10. The process according to claim 1 wherein, if the component (B) is the compound (a), said insolubilizer (D) is selected from the group consisting of molybdate, phosphomolybdate, tungstate, phosphotungstate, heteropolyacid containing molybdenum or tungsten.

11. The process according to claim 1 wherein, if the compound (B) is the compound (b), the insolubilizer is selected from the group consisting of the compound (a), a compound (e) represented by

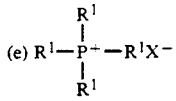

wherein $R^1$ and X are the same as mentioned above, and a compound (f) represented by

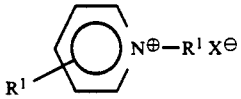

wherein $R^1$ and X are the same as mentioned above.

12. The process according to claim 1 wherein, if the compound (B) is the compound (c), said insolubilizer (D) is a chelating agent.

13. The process according to claim 1 wherein, if the compound (B) is the polymer (d) having a quaternary salt group, the insolubilizer (D) is selected from the group consisting of a molybdate, the compound (b) and a mixture thereof.

14. The process according to claim 1 wherein said organic particles (A) are employed in an amount of 2 to 100 parts by weight, based on 100 parts by weight of the dispersing medium (C).

15. The process according to claim 1 wherein said compound (B) is employed in an amount of 0.05 to 25 parts by weight and the insolubilizer (D) is 0.02 to 45 parts by weight, based on 100 parts by weight of the organic particles.

16. The process according to claim 1 wherein the obtained covered particles are subjected to a heat treatment at 40° to 90° C.

* * * * *